US005162851A

United States Patent [19]

Asakawa et al.

[11] Patent Number: 5,162,851

[45] Date of Patent: Nov. 10, 1992

[54] BRAKING SYSTEM FOR IMAGE FORMATION APPARATUS

[75] Inventors: Minoru Asakawa; Haruo Itakura; Utami Soma; Yasufumi Koseki; Kazumi Ishi; Hisao Sato, all of Hachioji, Japan

[73] Assignee: Konica Corporation, Tokyo, Japan

[21] Appl. No.: 614,928

[22] Filed: Nov. 16, 1990

[30] Foreign Application Priority Data

Nov. 20, 1989 [JP] Japan ..... 1-301289

[51] Int. Cl.[5] ..... G03G 15/28

[52] U.S. Cl. ..... 355/233; 355/205; 355/208

[58] Field of Search ..... 355/233, 235, 236, 205, 355/206, 208

[56] References Cited

U.S. PATENT DOCUMENTS 4,490,035 12/1984 Sugiura ..... 355/205 X
4,693,595 9/1987 Kunikawa et al. ..... 355/235 X

FOREIGN PATENT DOCUMENTS 53-115233 10/1978 Japan ..... 355/208
59-164543 9/1984 Japan ..... 355/208
59-228642 12/1984 Japan ..... 355/235
60-59342 4/1985 Japan .
0179759 3/1989 Japan ..... 355/233
01288874 11/1989 Japan ..... 355/233
026976 1/1990 Japan ..... 355/233

*Primary Examiner*—A. T. Grimley
*Assistant Examiner*—Shuk Y. Lee
*Attorney, Agent, or Firm*—Frishauf, Holtz, Goodman & Woodward

[57] ABSTRACT

A braking system for image forming apparatus returns an optical scan system in the image forming apparatus to a preselected home position after each scan of a document placed on a platen, within a predetermined period of time. Various factors including temperature, the number of copies of the document previously made, can change the operating performance of the braking system so that it does not return the optical scan system to the home position within the predetermined period. Detectors are provided to detect and sense the factors which will change the operating performance of the braking system. Brake control apparatus is responsive to the detectors and controls the braking system to return the optical scan system to its home position within the preselected period of time to thereby maintain the efficiency of the braking system even as the factors such as temperature, and number of copies previously made changes during operation of the image forming apparatus.

11 Claims, 7 Drawing Sheets

BRAKING SYSTEM FOR IMAGE FORMATION APPARATUS

BACKGROUND OF THE INVENTION

1. Field of the Invention

The present invention relates to an image formation apparatus like an electrophotographic copying apparatus for example. More particularly, the invention relates to an image formation apparatus which allows the optical scan system to perform return movement to the initial position with unlimited speed, i.e., with full power.

2. Description of the Prior Art

Any conventional image formation apparatus like an electrophotographic copying apparatus or an image scanner generates reciprocation of the optical scan system movably installed below a transparent platen in order to read the content of a document before transmitting the scanned optical image data either to a static latent image forming means or to a photoelectric conversion means via an optical means.

Taking an electrophotographic copying apparatus for example, the optical scan system consists of a light-exposure lamp for exposing the document to light, a number of reflection mirrors, and a lens, where the optical scan system reciprocates itself between a specific distance corresponding to the size of the document. When the copying apparatus remains inoperative, the optical scan system is at the original position which is called "home position". As soon as the copying operation is activated, the optical scan system starts to move itself, and simultaneously, the optical scan system reads the content of the document on the platen by exposing it to the scan light, and finally, the optical scan system returns to the home position.

In order to accelerate the speed of the copying operation, it is essential for the optical scan system to accelerate its return movement. To achieve this, it is quite important for the copying apparatus to prevent the optical scan system from colliding itself with the wall on the part of the home position. Based on this reason, a variety of devices are introduced to control the speed of the motor driving the optical scan system.

FIG. 1 graphically presents performance of a conventional system for controling the return movement of the optical scan system, in which solid line designates the movement under normal condition. The return movement of the optical scan system is controlled by detecting the actual position of the optical scan system by jointly operating a brake sensor BS and a home position sensor HPS.

First, the optical scan system starts up its return movement at time t0 in the direction of the home position at a very fast speed without applying any speed control means. Meanwhile the speed of the rotation of the optical-system drive motor increases relative to the passage of time. When the optical scan system arrives at the position of the brake sensor at time t1, the optical-system drive motor is driven in the inverse direction for a predetermined period of time to activate a braking force. As soon as the braking period is terminated at time t2, a phase-locked loop (PLL) mechanism is activated to control the speed of the rotation of the optical-system driver motor so that the optical scan system can move by itself at a specific speed. When the optical scan system arrives at the home-position sensor, the rotation of the optical-system drive motor is turned OFF at time t4 to complete the return movement of the optical scan system. After the time t4 is past, the optical scan system again starts to move itself in the forward direction to scan the content of the following document.

In order to accelerate the speed of the reciprocation of the optical scan system, it is essential for the image formation apparatus controlling the optical scan system to minimize the braking period by reversing the rotation of the drive motor before returning the optical scan system to the home position at a very fast speed. On the other hand, if the braking period were too short, the optical scan system cannot decelerate itself to the predetermined speed limit to avoid hitting against the wall of the home position. To prevent this, normally, any conventional image formation apparatus provides a certain braking period by reversing the rotation of the drive motor by providing the minimum period for preventing the optical scan system from hitting against the wall of the home position.

For example, when a copying apparatus continuously performs copying operations of documents, heat is internally generated from the light-exposure lamp to gradually raise temperature inside of the copying apparatus. As a result, coil resistance of the optical-system driving motor rises, whereas control current flowing through the coil decreases.

When full power is exerted to execute the initializing movement of the optical scan system at an unlimited speed in the conventional copying apparatus mentioned above, because of the decreased control current, immediately before reaching the time t1 at which braking force is applied by reverse rotation of the drive motor, the speed of the rotation of the drive motor slightly lowers as shown in FIG. 1 with a broken line. Nevertheless, the braking force applied in the inverse direction at the time t1 is subject to attenuation. In other words, the effect of attenuation dominates over the braking effect. In consequence, the optical scan system accelerates its returning speed at the time t2 at which the phase-locked loop control is activated.

If the braking duration were not provided with enough allowance against occurrence of collision with the wall of the home position, as mentioned above, the rise of temperature in the drive motor, and the moving speed of the optical scan system in the direction of the home position will gradually increase, thus causing collision to occur. If collision occurs, unwanted noise increases, and the durability of components decreases damage.

Provision of enough braking period effectively prevents the optical scan system from hitting against the wall of the home position. On the other hand, this in turn retards the operating speed of the optical scan system, thus eventually lowering the productive efficiency of the copying operation.

SUMMARY OF THE INVENTION

The object of the invention is to securely prevent the optical scan system from colliding itself with the wall of the home position without lowering the productive efficiency of the copying operation.

To achieve the above object, the invention provides a novel image formation apparatus comprising a detection means for detecting the physical amount of those factors including the passed time, internal temperature, and the number of the continuously copied paper, where the physical amount varies the braking performance of a specific means available for exerting braking force against the optical scan system on the way back to the home position; and a brake control means for the varying braking period according to the level of the physical amount above or below the predetermined value.

DETAILED DESCRIPTION OF THE PREFERRED EMBODIMENTS

Referring now more particularly to the accompanying drawings, embodiments of the invention are described below.

Figure 1:
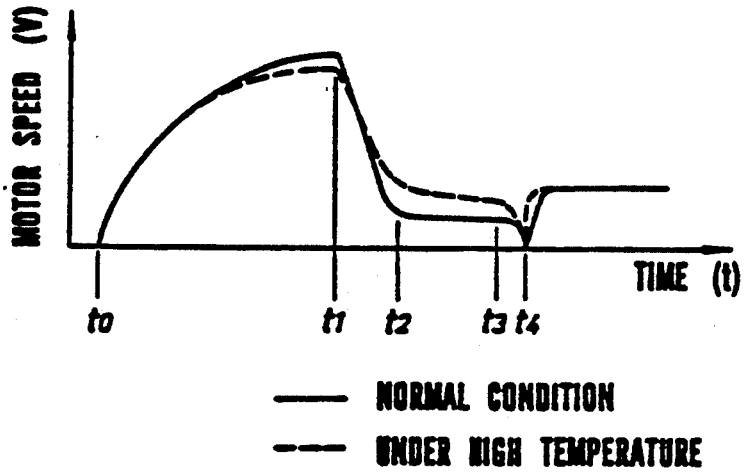
FIG. 1 PRIOR ART
FIG. 1 graphically shows the braking condition during the return movement of the optical scan system of a conventional image formation apparatus.
Figure 2:
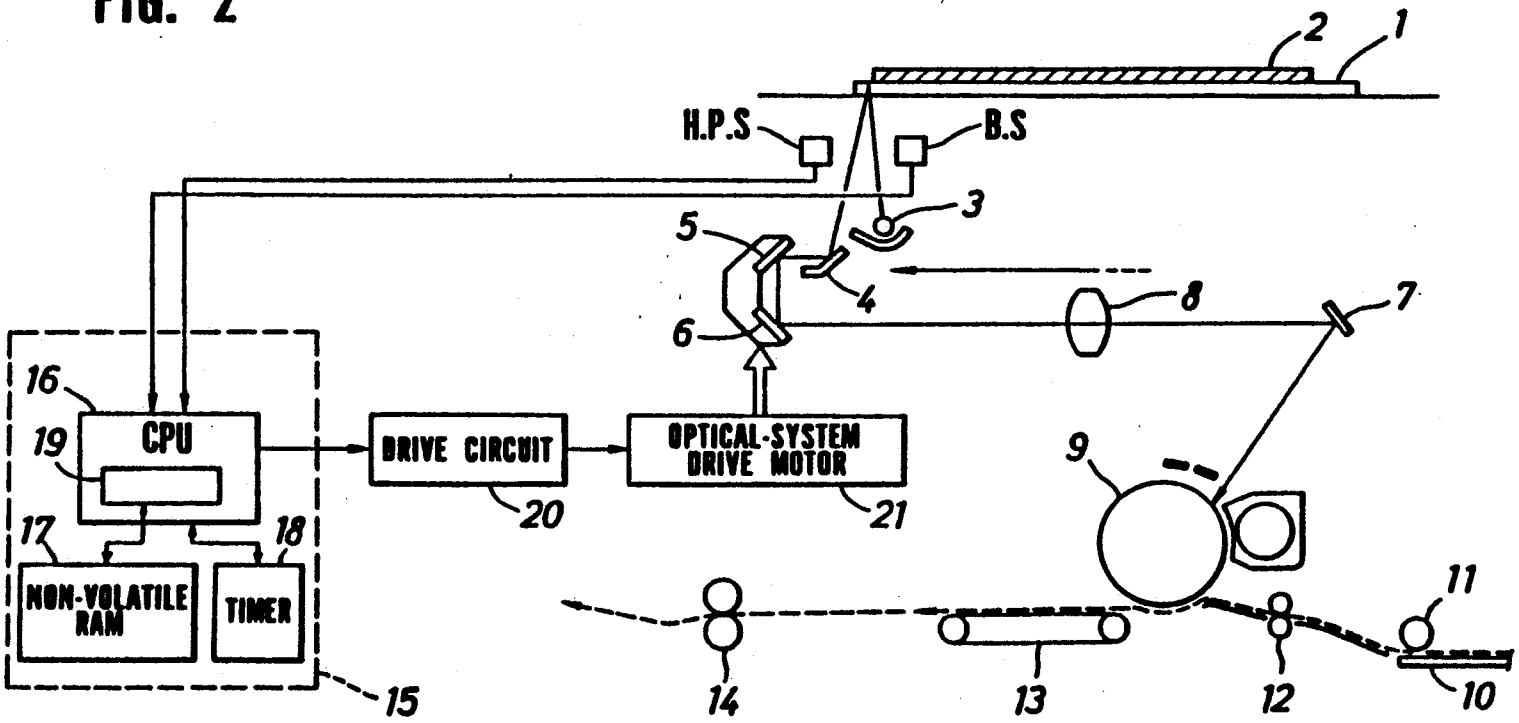
FIG. 2 schematically shows the structure of the image formation apparatus according to an embodiment of the invention.

FIG. 2 schematically designates the structure of the image formation apparatus according to an embodiment of the invention.

A document 2 as the object of the copying operation is placed on a top transparent platen. The optical scan system consists of a light-exposure lamp 3, a plurality of reflection mirrors 4 through 7, and a main lens 8. Light reflected by the document 1 lights up a photoreceiving drum 9 through optical members to cause a static latent image corresponding to the content of the document 1 to be generated on the photoreceiving drum 9.

Each of those copying papers stored in a copy-paper tray 10 is carried forward by the first and second paper feeding rollers 11 and 12 in the arrowed direction shown by means of a broken line, and then brought into contact with the photoreceiving drum 9. The photoreceiving drum 9 then transfers the image data of the content of the document 2 onto the copying paper. The image-printed paper is then ejected out of the copying apparatus via conveyer belt 13 and a paper-discharge roller 14 before eventually being stored in a storage tray (not shown).

A controller unit 15 for controlling the image scanning operation of the optical scan system incorporates a CPU 16, a non-volatile RAM 17, and a timer 18.

The non-volatile RAM 17 stores two kinds of threshold values for identifying the period from the moment of the passage of the optical scan system through the brake sensor BS until the moment of its arrival at the home position sensor HPS, where these two kinds of threshold values include the time threshold values t1 and t2 and the brake threshold values Bt1 and Bt2 for controlling the braking amount. The brake threshold values Bt1 and Bt2 are respectively determined to be 50 ms and 40 ms. In other words, the brake threshold value Bt1 contains more braking amount than the value Bt2. The time threshold value t1 corresponds to the brake threshold value Bt1, whereas the time threshold value t2 corresponds to the brake threshold Bt2, respectively This in turn means that t1 is more than t2.

The selected brake threshold values Bt1 and Bt2 are respectively entered in a register 19 which is provided in conjunction with the CPU 16. The CPU 16 delivers an instruction signal corresponding to the entered brake threshold values to a drive circuit 20. As a result, the braking period relative to the reverse rotation of the optical-system drive motor 21 is constantly held at an optimum value.

Figure 3:
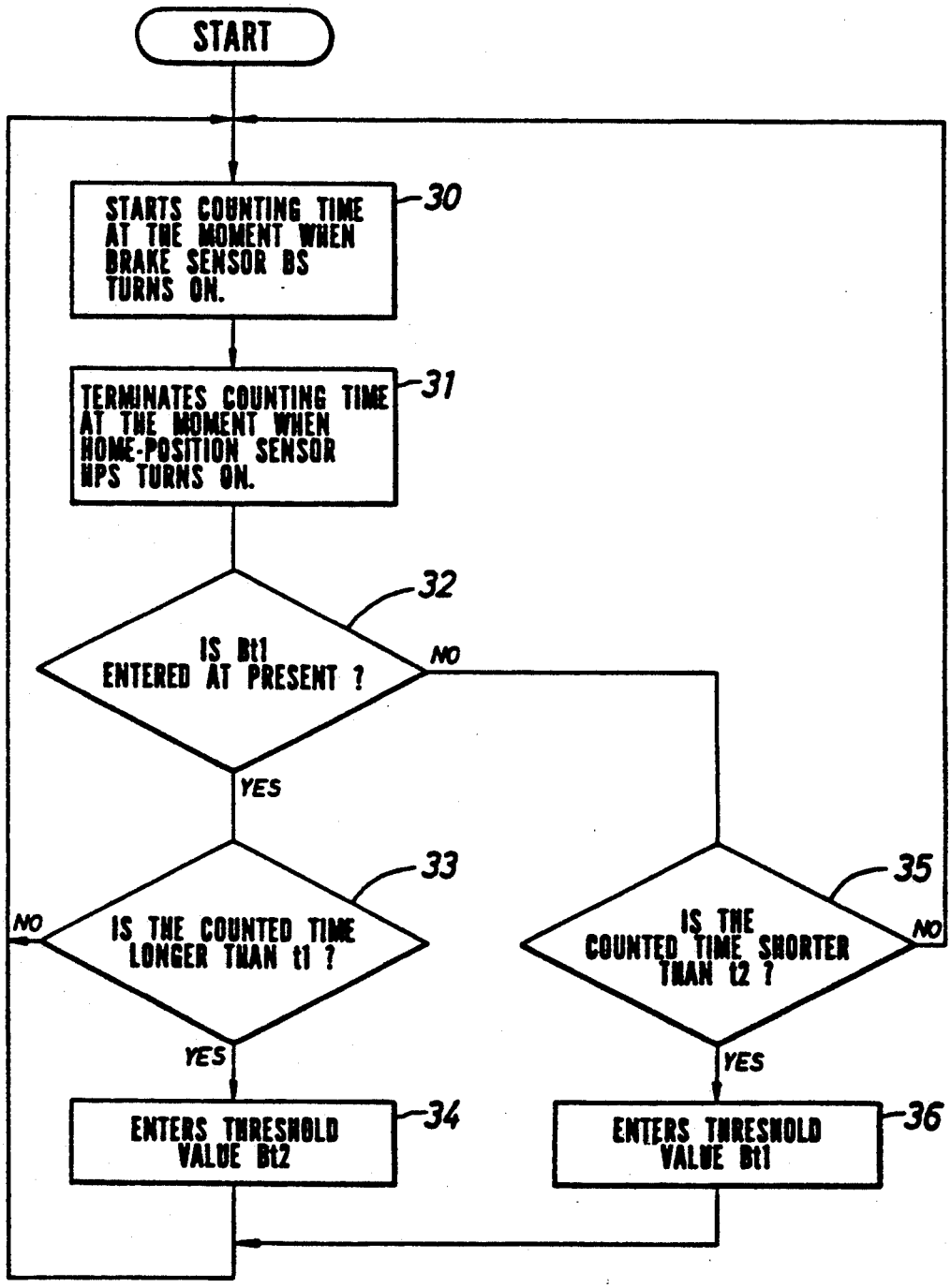
FIG. 3 shows a flowchart of the braking operation applied to the optical scan system of the embodiment of the invention shown in FIG. 2.

Next, referring to the flowchart shown in FIG. 3, sequence of the control operation of the controller unit 15 during the return movement of the optical scan system will be described below.

Initially, step 30 is entered, in which the brake sensor BS is turned ON to activate the timer 18 inside of the controller unit 15 to start counting of time.

Next, step 31 is entered, in which the timer 18 terminates the counting of time at the moment when the home position sensor HPS just turns OFF itself.

Next, step 32 is entered, in which the CPU 16 executes the value identifying routine. First, the CPU 16 identifies whether the brake threshold value entered in the register 19 is Bt1, or not. In other words, the CPU 16 identifies whether there is an excessive amount of brake, or not. If the amount of brake were excessive, then step 33 is entered, in which the CPU 16 identifies whether the counted time exceeds the time threshold value t1, or not. In other words, the CPU 16 identifies whether the period from the passage of the optical scan system through the brake sensor BS until its arrival at the home position sensor HPS exceeds the time threshold value t1, or not.

If the counted time actually exceeds the time threshold value t1, it indicates that excessive braking force was applied to the return movement of the optical scan system and retarted the moving speed before arrival at the home position.

To compensate for this, step 34 is entered, in which the CPU 16 sets the brake threshold value Bt2 to the register 19 so that the braking amount can be decreased. On the other hand, if the counted time were shorter than the time threshold value t1, then the operational mode returns to the initial step 30.

If the CPU 16 identifies that the entered brake threshold value were other than Bt1 while step 32 is underway, then step 35 is entered, in which the CPU 16 identifies whether the counted time is shorter than the time threshold value t2, or not. If the counted time were shorter than the time threshold value t2, it indicates that the returning speed of the optical scan system is too fast before causing it to collide with the wall of the home position. To compensate for this, step 36 is entered, in which the CPU 16 sets the brake threshold value Bt1 to the register 19 so that the braking amount can be increased. On the other hand, if the counted time were longer than the time threshold value t2, then the operational mode returns to the initial step 30.

The above embodiment of the invention provides the braking amount which is variable by an optional step like 5 ms-step for example. The timer 18 of the controller unit 15 counts the period from the arrival of the optical scan system at the brake sensor until its arrival at the home position sensor every cycle of the return movement of the optical scan system. Then, the CPU 16 sets the optimum braking amount in correspondence with the counted time. As a result, even when the optical scan system performs its return movement at an unlimited speed with full power, there is no possibility of causing the optical scan system to hit against the wall of the home position. This in turn provided an advantageous effect of promoting the productive efficiency of the copying operation with reliability.

Figure 4:
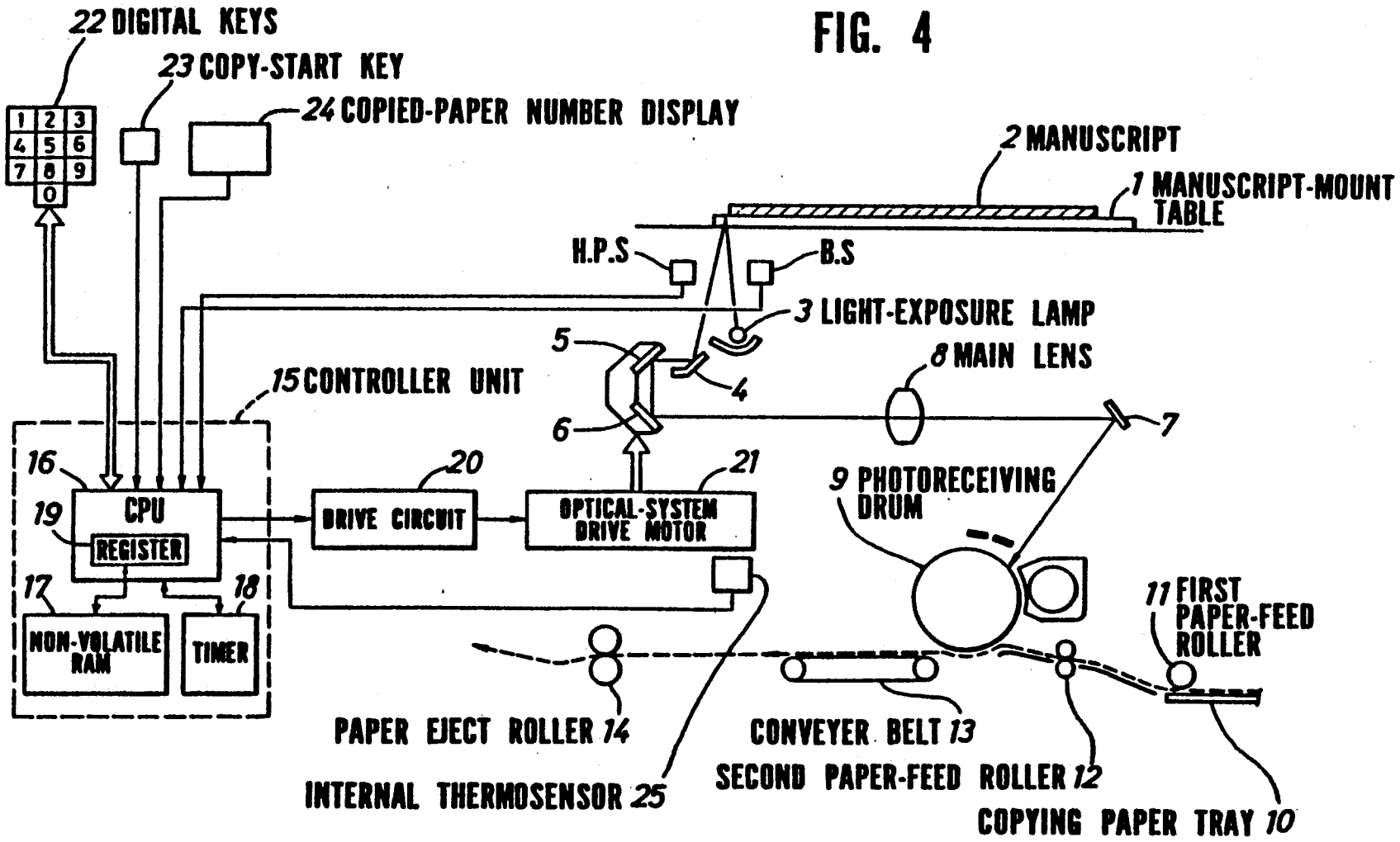
FIG. 4 schematically shows the structure of the image formation apparatus according to another embodiment of the invention.
Figure 5:
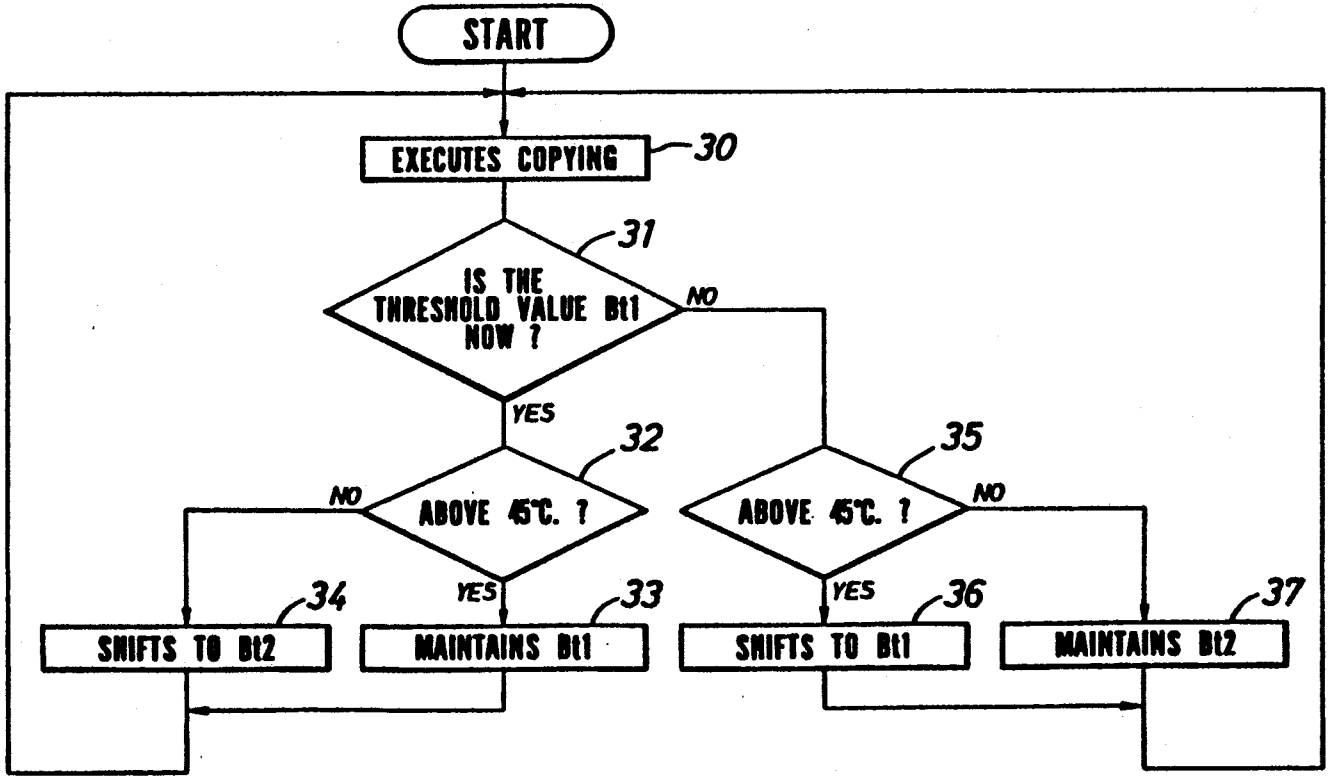
FIG. 5 shows a flowchart of the braking operation applied to the optical scan system of the embodiment of the invention shown in FIG. 4.
Figure 6:
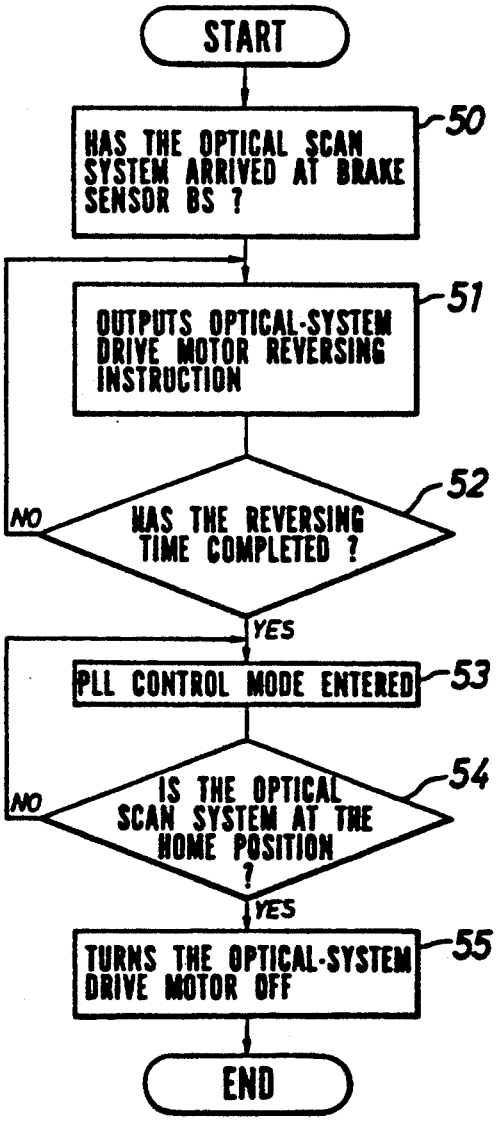
FIG. 6 shows a flowchart of the motor control operation applied to the optical scan system of the embodiment shown in FIG. 4.

FIGS. 4 through 6 respectively show the second embodiment of the image formation apparatus related to the invention. Those components shown in FIG. 4 are designated by those reference numerals identical to those which are shown in FIG. 2, and thus, description of these is deleted.

In order to detect temperature inside of the copying apparatus, the second embodiment of the invention provides an internal thermosensor 25 between the photoreceiving drum 9 and the optical scan system at a position close to the photoreceiving drum 9. The internal thermosensor 25 is not only made available for the compensation of the brake amount, but it is also properly available for the compensation of the current value and temperature.

The CPU 16 receives signals detecting the position of the optical scan system from a brake sensor BS and a home position sensor HPS and temperature-detect signal from the internal thermosensor 25.

When an operator inputs the predetermined number of papers to be copied by manually depressing digital keys 33, the CPU 16 instructs a display unit 24 to display the input number of copying paper. As soon as the operator depresses the copy-start key 33, the CPU 16 activates the driving of the optical scan system.

A non-volatile RAM 17 stores a threshold temperature value designating a specific degree (45° C. in the second embodiment) of temperature that can actually affect the performance characteristic of the optical-system driving motor, while the non-volatile RAM 17 also stores a specific number of copying paper as the threshold copy-paper number. In addition, the non-volatile RAM 17 also stores brake threshold values Bt1 and Bt2 for controlling the braking amount.

These brake threshold values Bt1 and Bt2 are respectively determined to be 50 ms and 45 ms. In other words, Bt1 contains more amount of brake than Bt2.

Next, referring to the flowchart shown in FIG. 5, sequence of the operation of the controller unit 15 for controlling the braking amount during the return movement of the optical scan system is described below.

First, the operator depresses digital keys 22 to input the number of papers to be copied that should continuously be subject to a copying routine, and then depresses the copy-start key 23 to enter into the copying operation. This activates the initial step 30. Next, step 31 is entered, in which the CPU 16 identifies whether the brake threshold Bt1 is entered in the register 19, or not.

If the brake threshold value were identified to be Bt1, then step 32 is entered, in which, based on the temperature-detect signal from the internal thermosensor 25, the CPU 16 identifies whether temperature inside of the copying apparatus has exceeded 45° C. of the threshold value, or not. If the internal temperature exceeds 45° C., it indicates that the state of the lowered brake characteristic is continuously present, and as a result, step 33 is entered, in which the CPU 16 holds the brake threshold value at Bt1. On the other hand, if the internal temperature were below 45° C., it indicates that the optical-system driving motor maintains normal performance characteristic, and thus, if the amount of brake were held at Bt1, it lowers the copying efficiency. To compensate for this, step 34 is entered, in which the brake threshold value is shifted to Bt2 so that the amount of brake can be decreased.

If the brake threshold value were other than Bt1 while step 31 is underway, then the operational mode proceeds to step 35, in which the CPU 61 identifies whether the internal temperature has exceeded 45° C. of the threshold value, or not. If the internal temperature were above 45° C., then step 36 is entered, in which the CPU 16 increases the braking amount by shifting the brake threshold value to Bt1. If the internal temperature were below 45° C., then step 37 is entered, in which the brake threshold value is maintained at Bt2.

FIG. 6 presents the flowchart showing the sequence of operation of the controller unit 15 for controlling the return movement of the optical scan system.

As soon as the optical scan system has arrived at the brake sensor position BS, the detect signal of the brake sensor BS turns ON. This activates the initial step 50 to allow the CPU 16 to acknowledge the arrival of the optical scan system at the brake sensor position BS. Then, step 51 is entered, in which the CPU 16 outputs a reversing instruction to instantaneously reverse the direction of the rotation of the optical-system driving motor 21. When the reversing period corresponding to the brake threshold value in the register 19 is past in the ensuing step 52, then the next step 53 is entered, in which the CPU 16 releases the reversing mode and then activates the phase-locked-loop control mode. When the CPU 16 detects that the optical scan system has just returned to the home position in the ensuing step 54, the CPU 16 turns the optical-system driving motor 21 OFF in the ensuing step 55, and then stands by itself for the following copying cycle.

The second embodiment of the invention provides a specific braking amount which is variable by an optional step like 5 ms-step for example. The second embodiment detects temperature inside of the copying apparatus, and if the internal temperature exceeds the predetermined degree, then the controller unit 15 compensates for the braking amount by increasing it. By virtue of these useful functions, such disadvantageous effect otherwise arising from variation of the moving speed of the optical scan system and from variation of the brake characteristic caused by the rise of temperature during the copying routine can fully be prevented from occurrence.

In consequence, even when the optical scan system performs its return movement at an unlimited speed with full power, there is no possibility of causing the optical scan system to hit against the wall of the home position. This in turn provides an advantageous effect of promoting the productive efficiency of the copying routine with reliability.

Figure 7:
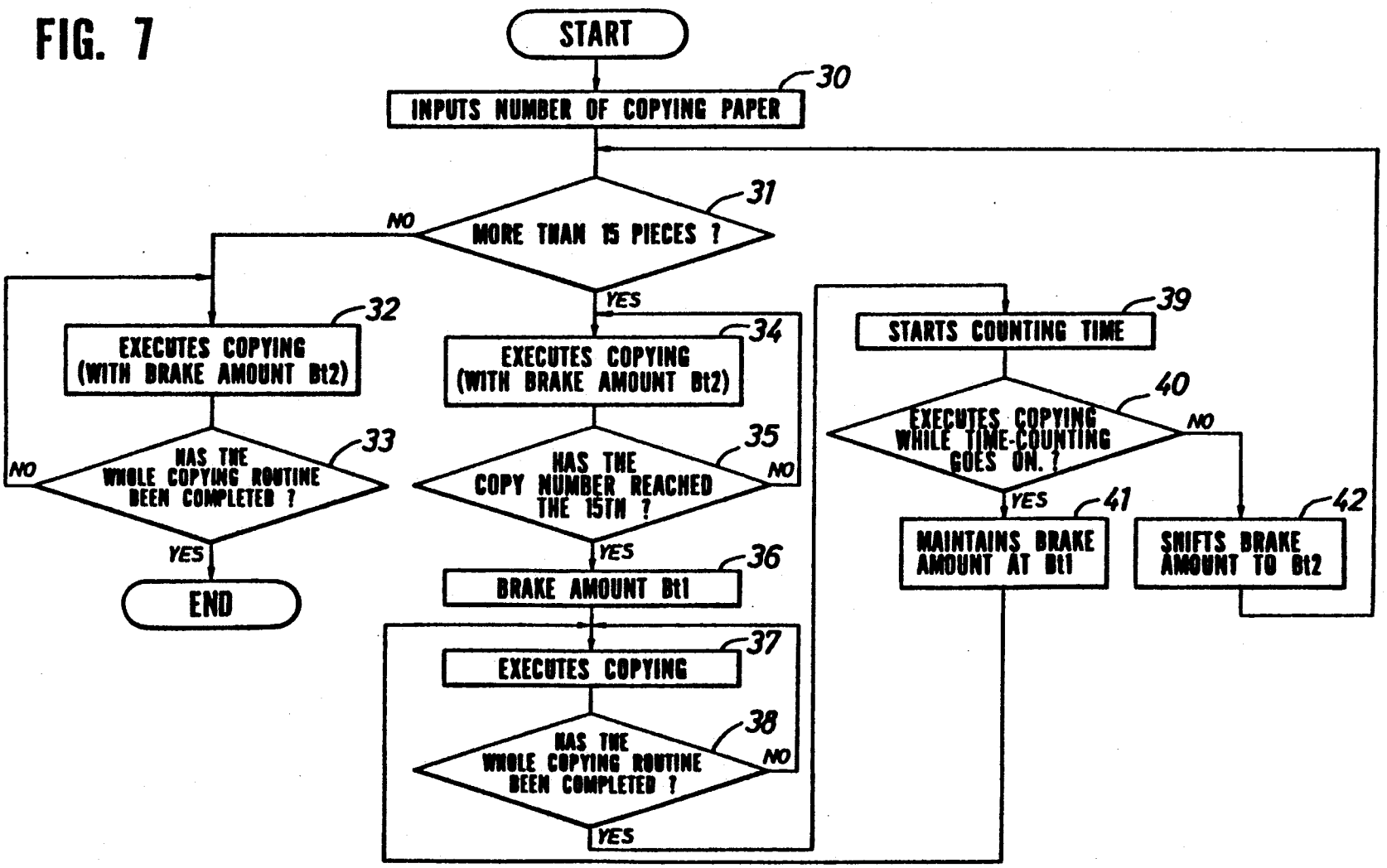
FIG. 7 shows a flowchart of the braking operation applied to the optical scan system of the image formation apparatus according to a still further embodiment of the invention.

FIG. 7 shows the flowchart of the control operation of the image formation apparatus according to the third embodiment of the invention. The structure of the image formation apparatus as per the third embodiment is identical to that is shown in FIG. 4, and thus, description of this is deleted.

The non-volatile RAM 17 of the third embodiment stores 15 pieces of the threshold value of the number of copying paper.

Referring now to the flowchart shown in FIG. 7, sequence of the operation of the controller unit 15 for controlling the braking amount during the return movement of the optical scan system is described below.

First, a copying operator depresses digital keys 22 to input the number of paper to be continuously copied. This activates the initial step 30. When the next step 31 is entered, the CPU 16 identifies whether the input number of paper to be continuously copied is more than 15 pieces of the threshold value, or not. If the input number of paper to be continuously copied were less than 15 pieces, then the CPU 16 sets the initial braking amount Bt2 to the register 19. Next, step 32 is entered, in which a copying routine is continuously executed. When the copying of all the input number of copying papers is completed, a final step 33 is entered to terminate the entire copying routine.

On the other hand, if there were more than 15 pieces of the input number of papers to be continuously copied, then step 34 is entered to execute a copying process by applying a brake amount corresponding to the brake threshold value Bt2. Next, step 35 is entered, in which the CPU 16 identifies whether the number of the copy-completed paper has reached 15 pieces, or not. When the number of the copy-completed paper has reached 15 pieces, the CPU 16 sets the brake threshold value Bt1 to the register 19 to execute a compensative process in order to extend the effective brake period by reversing the rotation of the motor in the following step 36. Next, step 37 is entered to execute the predetermined copying operation. Next, step 38 is entered, in which the CPU 16 confirms that the routine for copying all the predetermined number papers has been completed, thus terminating the entire copying operation.

Next, the CPU 16 identifies whether the corrected brake amount should be shifted to the initial threshold value Bt1, or not.

Concretely, immediately after the above step 38 is past, the next step 39 is entered, in which the CPU 16 activates the timer 18 to count time. The time to be counted by the timer 18 substantially corresponds to such a period which is needed for lowering the internal temperature raised by execution of continuous copying operations down to a specific degree at which compensation for the brake amount is no longer necessary. This value is preliminarily held by the CPU 16.

Next, step 40 is entered, in which, if the following copying process were executed while the timer 18 still counts the predetermined period of time, since the internal temperature is not fully cooled off, step 41 is then activated, in which the brake amount is held at the level of Bt1 so that the ensuing copying process can be executed by restraining speed of the return movement of the optical scan system.

If the following copying process were executed after the timer 18 has counted up the predetermined period of time, then the CPU 16 identifies that the internal temperature is already lower than the critical degree at which the performance characteristic of the optical-system driving motor starts to vary, and then, the final step 42 is entered to restore the brake amount back to the initial value Bt2. Finally, the operational mode returns to the initial step 31 to follow up the predetermined copying routine.

Those serial operations for controlling the return movement of the optical scan system are identical to those which are described regarding the second embodiment of the invention in reference to the flowchart shown in FIG. 6, and thus, description of these is deleted.

As is clear from the above description, the invention provides a specific braking amount which is variable by an optional step like 5 ms-step for example, and then counts the number of papers to be continuously copied. As soon as the predetermined time is counted up, the controller unit properly compensates for the braking amount by increasing it. By virtue of these useful functions, such disadvantageous effect otherwise arising from variation of the moving speed of the optical scan system and from variation of the brake characteristic caused by the rise of internal temperature during the copying operation can fully be prevented from occurrence. In consequence, even when the optical scan system performs its return movement at an unlimited speed with full power, there is no possibility of causing the optical scan system to hit against the wall on the part of the home position. This in turn provides such an advantageous effect of promoting the productive efficiency of the copying operation with reliability.

What we claim is:

1. A braking system for image forming apparatus having an optical scan system which starts at a home position and scans documents placed on a platen, upon forward movement of said optical scan system, and return means including said braking system for returning said optical scan system to said home position within a preselected period of time, the operating performance of said braking system changing from a predetermined efficient performance range with factors including temperature, said braking system comprising:

braking means for braking and substantially stopping said optical scan system at said home position;

detection means for detecting changes in said operating performance of said braking means; and brake control means responsive to said detection means for controlling said braking means to operate within said predetermined efficient performance range, thereby maintaining the efficiency of said braking system even as said factors sensed by said detecting means changes during operation of said image forming apparatus.

2. The system according to claim 1 further comprising:

energization means for activating said braking means for said preselected period beginning at a first predetermined time; and wherein said brake control means controls said energization means to vary said preselected period during which said braking means is activated to compensate for changes of said factors sensed by said detection means and said changes in said operating performance detected by said detecting means to enable said braking means to operate within said predetermined efficient performance range.

3. The system according to claim 2, wherein:

said detection means comprises timing means for measuring an elapsed time between said first predetermined time and the time at which said optical system substantially returns to said home position; and said brake control means controls said energization means whenever said elapsed time exceeds said preselected period.

4. The system according to claim 2, wherein:

said detection means comprises temperature measuring means for measuring the temperature inside said image forming apparatus; and said brake control means controls said energization means to extend said preselected period whenever the detected temperature inside said image forming apparatus exceeds a given value.

5. A braking system for image forming apparatus having an optical scan system which starts at a home position and scans documents placed on a platen, upon forward movement of said optical scan system, and return means including said braking system, for returning said optical scan system to said home position within a predetermined period, the operating performance of said braking system changing from a predetermined efficient performance range whenever a number of copies of said documents previously made exceeds a given number, said braking system comprising:

braking means for braking and substantially stopping said optical scan system at said home position;

counting means for counting the number of said copies which have been previously made; and brake control means responsive to said counting means for controlling said braking means to operate within said predetermined efficient performance range whenever said number of copies previously made exceeds said given number.

6. An image forming apparatus comprising:

an optical scan system which scans a document on a platen during a forward movement of said optical scan system from a first home position to a second position;

braking means for braking said optical scan system during a backward movement of said optical scan system from said second position to said first home position;

time measuring means including a first sensor positioned between said first home position and said second position, for measuring an elapsed time, during backward movement of said optical scan system, between a first time when said optical scan system is sensed by said second sensor and a second time when said optical scan system is sensed by said first sensor, wherein said optical scan system is sensed by said first sensor, while a phase-locked loop is activated so that said optical scan system moves to said first sensor at uniform speed;

comparing means for comparing the measured elapsed time with at least one of a first and a second threshold value, and for generating comparison output signals indicative of the comparison; and brake control means responsive to the comparison output signals for controlling the braking means to operate for a given period of time dependent on said comparison output signals.

7. The system according to claim 6, further comprising:

energization means for activating said braking means for said given period of time beginning at a first predetermined time; and wherein:

said brake control means controls said energization means to vary said given period of time during which said braking means is activated to compensate for changes in said measured elapsed time measured by said time measuring means.

8. The apparatus of claim 6, further comprising:

energization means for activating said braking means for said given period of time beginning at a given predetermined time.

9. The apparatus of claim 6, wherein said first and second threshold values correspond to respective time durations, said first threshold value being longer than said second threshold value, and wherein, when said measured elapsed time exceeds said first threshold value, said comparing means generates said comparison output signals to shorten said given period of time during which said brake control means operates, and wherein, when said measured elapsed time is shorter than said first threshold value, said comparing means generates said comparison output signals to extend said given period of time.

10. The apparatus of claim 6, wherein said given period of time comprises a first and a second period of time, the first period of time being longer than the second period of time.

11. The apparatus of claim 10, wherein:

said first and second threshold values correspond to respective time durations, said first threshold value being longer than said second threshold value;

said first period of time corresponding to said first threshold value and said second period of time corresponding to said second threshold value;

wherein, when said given period of time is the same as said first period of time and said measured elapsed time exceeds said first threshold value, said given period of time is changed into said second period of time; and wherein when said given period of time is the same as said second period of time and said measured elapsed time is shorter than said second threshold value, said given period of time is changed into said first period of time.

* * * * *